US007845417B2

(12) United States Patent
Warren et al.

(10) Patent No.: US 7,845,417 B2
(45) Date of Patent: Dec. 7, 2010

(54) METHOD OF CIRCULATING WHILE RETRIEVING DOWNHOLE TOOL IN CASING

(75) Inventors: Tommy M. Warren, Coweta, OK (US); Preston T. Honeycutt, Magnolia, TX (US); Michael Brouse, Houston, TX (US)

(73) Assignee: Tesco Corporation, Houston, TX (US)

( * ) Notice: Subject to any disclaimer, the term of this patent is extended or adjusted under 35 U.S.C. 154(b) by 195 days.

(21) Appl. No.: 12/184,851

(22) Filed: Aug. 1, 2008

(65) Prior Publication Data

US 2010/0025113 A1 Feb. 4, 2010

(51) Int. Cl.
*E21B 23/00* (2006.01)

(52) U.S. Cl. ..... 166/377; 166/90.1

(58) Field of Classification Search ..... 166/377, 166/90.1; 175/57

See application file for complete search history.

(56) References Cited

U.S. PATENT DOCUMENTS

| | | | | |
|---|---|---|---|---|
| 4,651,837 | A | 3/1987 | Mayfield | |
| 5,197,553 | A * | 3/1993 | Leturno | 175/57 |
| 5,472,057 | A * | 12/1995 | Winfree | 175/57 |
| 7,044,241 | B2 | 5/2006 | Angman | |
| 7,140,443 | B2 | 11/2006 | Beierbach et al. | |
| 7,140,455 | B2 | 11/2006 | Walter et al. | |
| 7,604,057 | B1 * | 10/2009 | Eriksen et al. | 166/377 |
| 7,665,515 | B2 * | 2/2010 | Mullins | 166/90.1 |
| 2001/0042625 | A1 * | 11/2001 | Appleton | 166/379 |
| 2002/0029879 | A1 * | 3/2002 | Mosing et al. | 166/90.1 |
| 2002/0066558 | A1 * | 6/2002 | Mullins | 166/90.1 |
| 2003/0217843 | A1 * | 11/2003 | Mullins | 166/90.1 |
| 2004/0026126 | A1 * | 2/2004 | Angman | 175/57 |
| 2006/0124306 | A1 | 6/2006 | Vail, III | |
| 2007/0074908 | A1 | 4/2007 | Utter | |

* cited by examiner

*Primary Examiner*—Hoang Dang
(74) *Attorney, Agent, or Firm*—Bracewell & Giuliani LLP

(57) ABSTRACT

Retrieving a down hole tool at a lower end of a string of casing can be performed with drill pipe during a casing-while-drilling operation. The operator suspends the casing in the well from a drilling rig floor opening. A string drill pipe is lowered into the casing while the casing is suspended for engaging and retrieving the down hole tool. When circulation is desired, the operator secures a circulation tool to an upper end of the drill pipe, then lowers the drill pipe and the circulation tool to close off an upper end of an inner annulus between the drill pipe and the casing. The operator circulates fluid down the circulation tool and the drill pipe and back up an outer annulus surrounding the casing. The connection between the circulation tool and the casing allows the operator to reciprocate the casing.

20 Claims, 4 Drawing Sheets

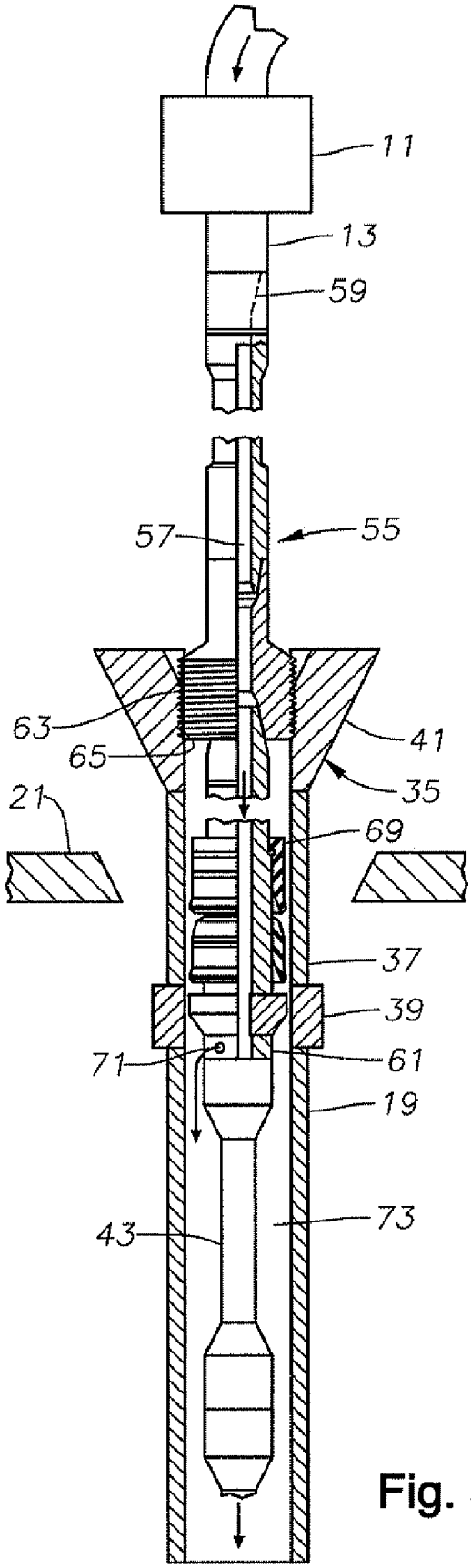
Fig. 5
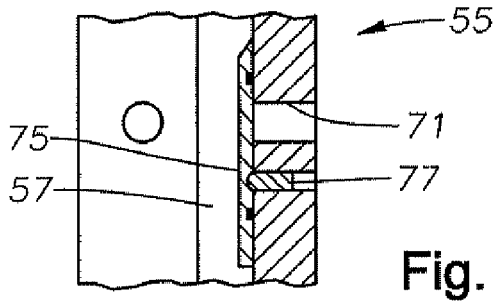
Fig. 6
Fig. 7
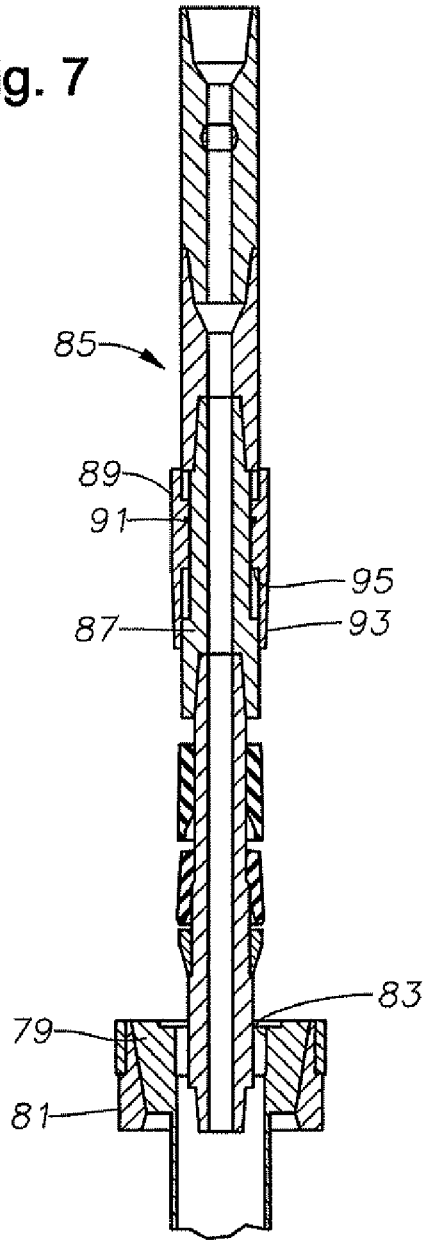

METHOD OF CIRCULATING WHILE RETRIEVING DOWNHOLE TOOL IN CASING

FIELD OF THE INVENTION

This invention relates in general to casing wells while drilling and in particular to circulating and reciprocating the casing while retrieving the bottom hole assembly with drill pipe.

BACKGROUND OF THE INVENTION

Most oil and gas wells are drilled using drill pipe. After a certain depth is reached, the operator runs a string of casing into the open borehole and cements the casing in place. The operator may then run drill pipe into the casing to drill below the casing to a greater depth. In a casing-while-drilling technique, all or a portion of the well is drilled using the casing as the drill string. The operator mounts a bottom hole assembly to the lower end of the casing. The bottom hole assembly includes a drill bit and a reamer. The operator may rotate the casing, which in turn rotates the drill bit to drill the well. The operator may also employ a mud motor that rotates the drill bit relative to the casing in response to drilling mud pumped down the casing.

Prior to reaching the total desired casing setting depth, the operator may wish to retrieve the bottom hole assembly, such as to replace a worn drill bit. Also, when reaching the casing setting depth or total depth, the operator may wish to retrieve the bottom hole assembly rather than cement it in place. One technique for retrieving the bottom hole assembly is to lower a wireline through the casing, latch it to the bottom hole assembly, then retrieve the wireline along with the bottom hole assembly. While successful, this technique requires special equipment not always found on a drilling rig, such as a wireline winch and sheaves to guide and lower the wireline into the casing. Another technique involves pumping the bottom hole assembly up the casing by reverse circulating. However, some operators fear that reverse circulation will damage the open hole formation. Another technique involves running drill pipe through the casing, latching the drill pipe to the bottom hole assembly, then retrieving the drill pipe along with the bottom hole assembly. Most drilling rigs will have equipment of this nature available.

Running the drill pipe and tripping it out to retrieve a bottom hole assembly takes a number of hours, depending on the depth of the well. A possibility exists that the casing may become stuck in the well while the drill pipe is tripped in and out. This can particularly be a problem if the operator plans to drill deeper with the string of casing. To avoid the casing sticking, it would be desirable to circulate up the outer annulus between the casing and the bore hole from time to time. Also, reciprocating the casing up and down reduces the chances of it becoming stuck.

Another issue while retrieving and re-running a bottom hole assembly is to provide a safety barrier in the event that a formation begins to flow liquid or gas, referred to as a "kick" while the drill pipe is located inside the casing. It is known that if such a kick occurs while running casing, the kick can normally be controlled by circulating fluid through the casing. However, no arrangement presently exists that allows circulation through the casing while a string of drill pipe is being run in or retrieved inside casing.

SUMMARY OF INVENTION

When the operator wishes to retrieve a bottom hole assembly or down hole tool from the casing during a casing-while-drilling operation, he will first suspend the casing in the well from a drilling rig floor opening, such as the rotary table. The operator runs a string of conduit, normally drill pipe, into the casing while the casing is suspended in order to engage and retrieve the down hole tool. When circulation is desired, either while running the drill pipe in or tripping it out, the operator secures a circulation tool to the upper end of the drill pipe. He then lowers the drill pipe and the circulation tool so that the circulation tool closes off an upper end of the inner annulus between the drill pipe and the casing. The operator then circulates fluid down through the circulation tool and drill pipe and back up an outer annulus surrounding the casing.

In the preferred embodiment, the operator suspends the casing at the rig floor by securing a landing sub to the upper end of the casing. The operator then lowers the landing sub to a seating position into and flush with the top of a rotary table.

Preferably the circulation tool has a seal around its exterior that seals to the landing sub or to the casing to close off the inner annulus. Optionally, the circulation tool may have a circulation port leading from its axial flow passage to its exterior below the seal. Some of the fluid being pumped down the axial passage may be diverted through the port and down the inner annulus. In one embodiment, the port can be closed, if desired, by moving a sliding sleeve so that all the fluid being pumped through the axial flow passage passes down through the drill pipe.

In another embodiment, the circulation tool has an inner pipe with a lower threaded end that connects to the drill pipe and an upper threaded end that connects to the top drive. An outer housing surrounds the inner pipe, defining an annular chamber between the inner pipe and the outer housing. The outer housing is threaded on its lower end so as to connect to the landing sub. The bottom of the annular chamber is open and in fluid communication with the inner annulus between the drill pipe and the casing. A side port allows the operator to pump fluid into the annular chamber and down the inner annulus of the casing.

In addition to circulating, the circulation tool also allows the operator to reciprocate the casing up and down while the drill pipe is located inside. The circulation tool and the landing sub have a cooperative fastener to connect the circulation tool to the landing sub. Cooperative fastener may be threads, snap ring and grooves, collets and locking dogs, or other tubular connectors. Lifting the circulation tool with the top drive causes the landing sub, the casing, and the drill pipe to move upward in unison. The reciprocation can occur simultaneously while pumping fluid down the drill pipe.

BRIEF DESCRIPTION OF THE DRAWINGS

FIG. 5 is a schematic, partially sectional view of the circulation tool of FIG. 4, but showing the casing and the drill pipe being lifted by the top drive.

FIG. 6 is an enlarged sectional view illustrating a sliding sleeve in the circulation sub of FIG. 5.

FIG. 7 is a more detailed sectional view of the circulation sub of FIG. 4.

DETAILED DESCRIPTION OF INVENTION

Figure 1:
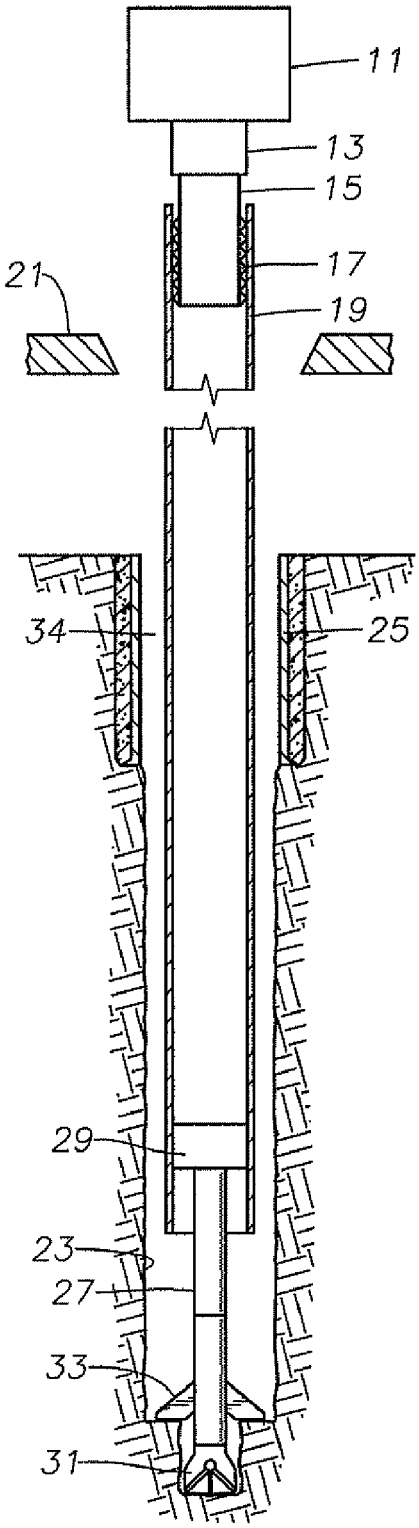
FIG. 1 is a schematic sectional view of a top drive, casing gripper and casing string assembly employed in this invention and performing casing drilling.

Referring to FIG. 1, top drive 11 is a conventional top drive of a drilling rig that moves up and down a derrick (not shown). Top drive 11 has a drive quill 13 that it rotates. A casing gripper 15 is mounted to drive quill 13 during a casing-while-drilling operation. Casing gripper 15 has slips 17 on a lower portion that are moved radially by an actuator to grip casing 19. In this embodiment, slips 17 are moved outward to grip the inner diameter of casing 19. Alternatively, the slips of casing gripper 15 could be arranged to fit around the casing and move inward to grip the exterior of casing 19.

Casing 19 is a string of conduit made up of sections of pipe secured together by couplings or casing collars. Casing 19 is eventually cemented in a wellbore to line the wellbore. Normally casing 19 extends from the bottom to the top of the wellbore where it is secured to a wellhead assembly (not shown). The term "casing" is also meant to include other tubular strings cemented in a well, such as liners, which are also threaded pipes that are cemented in a well; unlike casing strings, liners do not extend all the way back to the surface.

Casing 19 extends through an opening in the rig floor structure, such as rotary table 21. Rotary table 21 normally has the ability to rotate pipe suspended by it. Casing 19 extends into an open hole portion of well 23. In this embodiment, an upper string of casing 25 is illustrated as being previously cemented in place.

A down hole tool or bottom hole assembly 27 is carried at or near the lower end of casing 19. Bottom hole assembly 27 extends out the lower end of casing 19 and has an upper portion 29 that may comprise a latch that latches to a profile within casing 19. A pilot bit 31 is attached to the lower end of bottom hole assembly 27. A reamer 33 is located either at the lower end of casing 19 or some distance below for reaming out an outer portion of well 23 being drilled by pilot bit 31. Reamer 33 is typically collapsible to allow bottom hole assembly 27 to be retrieved upwards inside casing 19. During the drilling operation, drilling fluid or mud is circulated through top drive 11, casing gripper 15, casing 19 and out nozzles at the lower end of drill bit 31. The drilling fluid circulates back up an outer annulus 34 between casing 19 and well 23.

Figure 2:
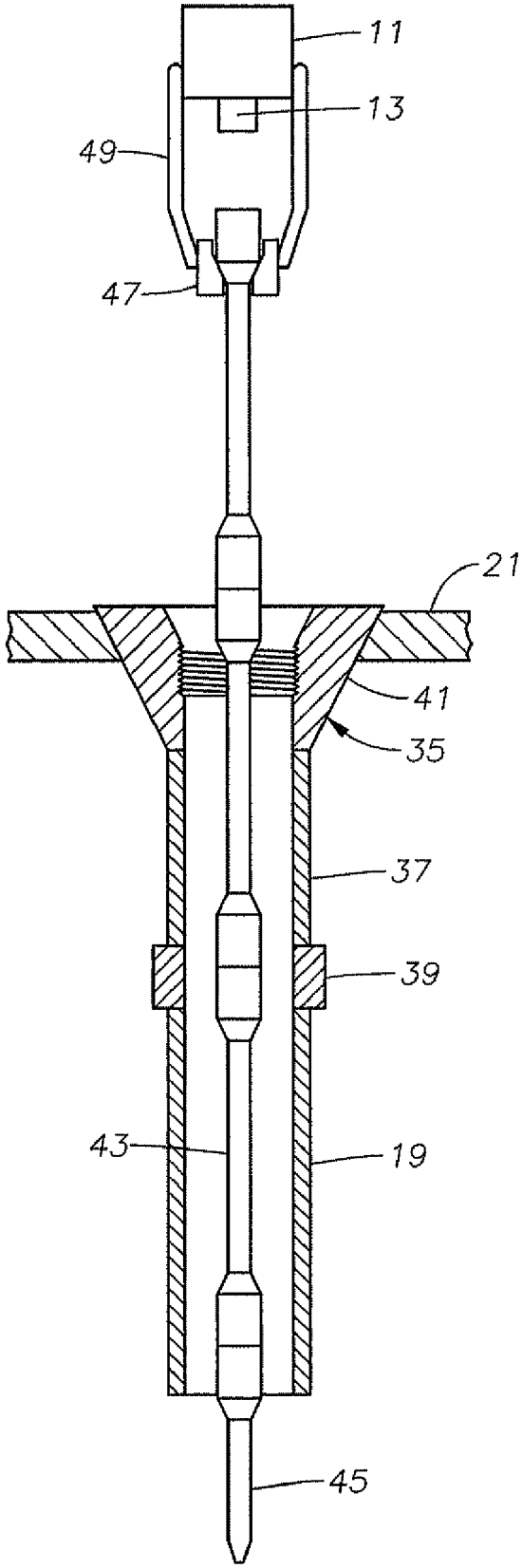
FIG. 2 is a schematic sectional view of part of the assembly of FIG. 1, shown retrieving the drill bit with a string of drill pipe.

The operator will need to retrieve bottom hole assembly 27 when reaching total depth unless the bottom hole assembly 27 is of a type to be cemented in place. Also, the operator may need to retrieve bottom hole assembly 27 before reaching total depth, such as to change out drill bit 31. To retrieve bottom hole assembly 27, the operator will first suspend casing 19 independently of top drive 11, as illustrated in FIG. 2. In this embodiment, preferably casing 19 is suspended by first attaching a landing sub 35 to the casing collar 39 at the upper end of the string of casing 19. Landing sub 35 has a tubular lower portion or adapter 37 with an externally threaded end for engaging casing collar 39. Alternatively, the landing sub may employ a non-threaded fastener for engaging casing collar 39. Landing sub 35 has an upper end 41 that is enlarged and has a tapered surface on its exterior. Preferably, lower portion 37 is releasably secured to upper end 41 so that it can be readily changed out for different sizes of casing 19. Lower portion 37 may be releasably secured to upper end 41 using threads, snap ring and grooves, collets and locking dogs, or other tubular connectors. The exterior tapered surface of upper end 41 increases in diameter in an upward direction for mating within the bowl in rotary table 21. When seated within rotary table 21 as shown in FIG. 2, the upper end of landing sub 35 is substantially flush with rotary table 21.

Once casing 19 is suspended as shown in FIG. 2, the operator will use top drive 11 to make up and lower a string of conduit, normally drill pipe 43. Drill pipe 43 is made up of sections of pipe with integral upset ends that are secured together. A retrieving tool 45 is mounted on the lower end of the string of drill pipe 43 for engaging latch assembly 29 (FIG. 1) of bottom hole assembly 27. Retrieving tool 45 unlatches bottom hole assembly 27 from casing 19 and latches to bottom hole assembly 27 for retrieval. When running drill pipe 43, the operator would normally use elevators 47 for lowering the string of drill pipe 43 into casing 19. Elevators 47 are mounted on bails 49 that are pivotally secured to top drive 11.

Figure 3:
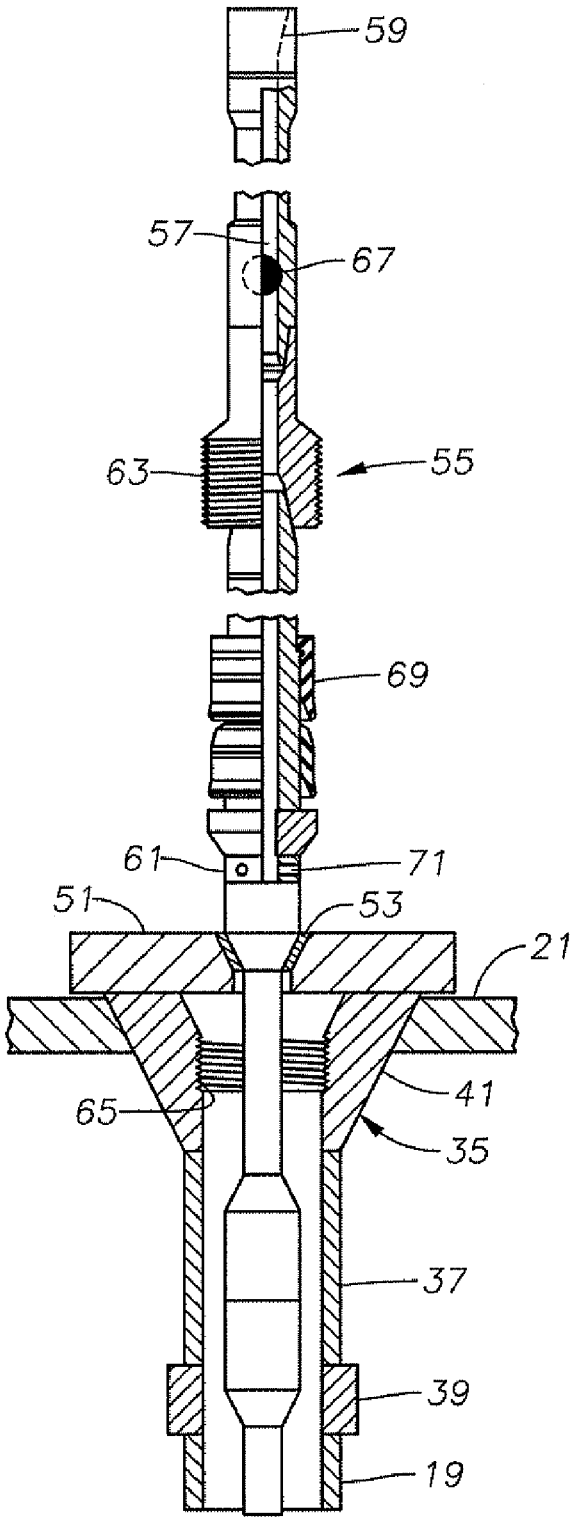
FIG. 3 is a schematic sectional view similar to FIG. 2, but showing the string of drill pipe supported on a spider.

At one or more occasions while tripping drill pipe 43 in and out, the operator will likely wish to circulate down casing 19 and up outer annulus 34 (FIG. 1) as well as reciprocate casing 19 to avoid casing 19 becoming stuck. Circulation also reduces the chance of a kick occurring due to inflow of gas or other fluid from one of the formations in the open hole portion of well 23 (FIG. 1). Furthermore, if a heavier fluid is circulated down casing 19, the heavier fluid may be sufficient to overcome the kick. The operator may wish to circulate and reciprocate casing 19 more than once while tripping drill pipe 43 in and more than once while tripping drill pipe 43 out. Each time the operator wishes to circulate and reciprocate, he will first suspend drill pipe 43 independently of top drive 11 (FIG. 2), as shown in FIG. 3. In FIG. 3, the operator places a spider 51 over the upper end of landing sub 35. Spider 51 has slips 53 that will support the string of drill pipe 43.

Figure 4:
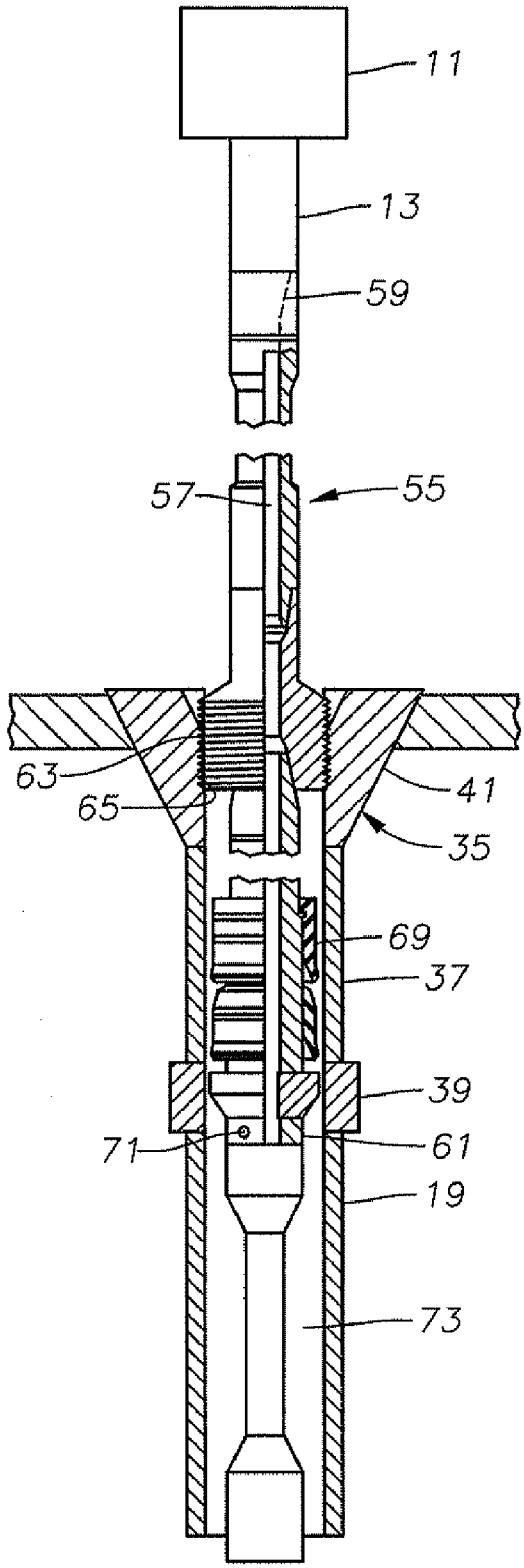
FIG. 4 is a schematic, partially sectional view of a circulation tool in accordance with this invention, installed within a landing sub, connected to drill pipe, and shown supported on a rotary table.

Then, using top drive 11 (FIG. 2) or another means, the operator will lift a circulation tool 55 above the suspended drill pipe 43 as illustrated in FIG. 3. Circulation tool 55 has an axial passage 57 extending through it. Circulation tool 55 has a threaded upper end 59 that is secured to drive quill 13 of top drive 11 (FIG. 2). Circulation tool 55 has a threaded lower end 61 that connects to the upper end of the string of drill pipe 43, either directly or via an adapter (not shown). Alternatively, the connection between the circulation tool 55 and the lower end 61 may use snap ring and grooves, collets and locking dogs, or other tubular connectors. A mid section of circulation tool 55 has an engagement member for securing circulation tool 55 to landing sub 35. In this embodiment, the engagement member comprises external threads 63 on the mid section of circulation tool 55 that engage internal threads 65 in landing sub 35. Threads 63 are preferably rotatable relative to circulation tool 55. Other arrangements are possible, such as a J-pin and slot, a breach lock, or a floating threaded drive nut. FIG. 4 shows top drive 11 lowering circulation tool 55 and drill pipe 43 into a position wherein external threads 63 are engaging internal thread 65. The drilling rig tongs (not shown) can be used to make up circulation tool 55 with landing sub 35.

Circulation tool 55 may also optionally have a ball valve 67 in axial passage 57 to block upward flow of fluid if desired. In addition, in this embodiment, circulation tool 55 has a cup seal 69 (two shown) that will seal and engage the inner diameter of casing 19 or landing sub 35. Other casing seals (o-rings, d-rings, FS seals, etc.) may also be used on the circulation tool 55 to effect a seal with the casing. Preferably the inner diameter of the lower portion 37 of landing sub 35 is the same as the inner diameter of casing 19, thus cup seal 69 can seal to the inner diameter of casing 19 or to the inner diameter of landing sub lower portion 37.

Also, circulation tool 55 optionally may have one or more circulation ports 71 (FIG. 5). Each port 71 extends from axial passage 57 to the exterior of circulation tool 55 below cup seal 69. Ports 71 thus communicate axial passage 57 with an inner annulus 73 located between drill pipe 43 and casing 19. In the embodiment of FIGS. 3-5, inner annulus circulation ports 71 are always open. Alternately, the operator may wish to selectively close inner annulus ports 71. FIG. 6 illustrates one arrangement showing a selectively closed arrangement. A sliding sleeve 75 is mounted in axial passage 57 in an initial position blocking inner annulus ports 71. Sleeve 75 can be moved from an upper to a lower position to open ports 71 to axial passage 57. In this example, sleeve 75 has a shear pin 77 mounted to it. The operator opens sleeve 75 by dropping a ball or dart into axial passage 57. Fluid pressure from a pump at the surface is applied to the ball or dart, causing shear pin 77 to shear, and moving sleeve 75 downward. Also, threaded screw-in plugs could be employed to close ports 71, if desired. Other known plugging or valving arrangements may also be used to close the port 71 if desired.

In the operation of the embodiment of FIGS. 1-5, to retrieve bottom hole assembly 27, the operator will temporarily support casing 19 in slips of rotary table 21. The operator then attaches landing sub 35 to casing 19 and lowers the assembly until landing sub 35 seats within rotary table 21. The operator then runs a string of drill pipe 43 into casing 19 with top drive 11, as shown in FIG. 2. Periodically, the operator attaches circulation tool 55 between top drive 11 (FIG. 4) and drill pipe 43 as shown in FIG. 3. The operator lowers circulation tool 55 with top drive 11 and rotates threads 63 into engagement with landing sub threads 65. The operator then reciprocally lifts and lowers circulation tool 55 with top drive 11, as shown in FIG. 5. This causes landing sub 35, casing 19 and drill pipe 43 to move upward in unison. At the same time, the operator pumps drilling fluid down top drive 11, which flows through circulation tool axial passage 57, and downward through drill pipe 43. Some of the fluid is diverted through ports 71 to flow down inner annulus 73 between drill pipe 43 and casing 19. The fluid flowing down inner annulus 73 circulates the drilling mud contained within casing 19.

When the upward and downward reciprocation and circulation has gone on for a desired interval, the operator lowers landing sub 35 back to its seated position in FIG. 3. The operator removes circulation tool 55 and continues to either trip drill pipe 45 in or out. The operator will eventually engage retrieval tool 45 with the bottom hole assembly upper portion 29. This engagement is performed conventionally. The operator releases any latches that upper portion 29 may have with casing 19 and retrieves the entire bottom hole assembly 27. The operator may wish to circulate and reciprocate periodically while tripping out of the well with bottom hole assembly 27. If so, the operator repeats the procedure described above.

FIG. 7 illustrates an alternate embodiment, which is a more detailed version of the schematic drawing of circulation tool 55. Circulation tool 85 has a tubular multi-piece body 87. A floating nut 89 is mounted to a central portion of body 87 for movement between upper and lower positions. Nut 89 has an inner seal 91 that seals on an outer diameter portion of body 87. Nut 89 has external threads 93 that will engage landing sub threads 65 (FIG. 4). Nut 89 can be rotated relative to body 87 and may have lugs or a hexagonal exterior to facilitate that rotation. Upper and lower shoulders 95 limit the axial travel of nut 89 relative to body 87. The lower shoulders 95 will transmit the upward force when circulation tool 85 is lifted by top drive 11 (FIG. 5). Floating nut 89 allows circulation tool 85 to be connected to the landing sub without having to rotate circulation tool 85 and drill pipe 43 (FIG. 5). Floating nut 89 also can limit the axial loading on the threads 93 and 65 (FIG. 4) during the thread engagement period, and thus can prevent damage to the threads.

In the embodiment of FIG. 7, landing sub upper end 79 lands within a casing bushing 81, which in turn fits within rotary table 21 (FIG. 5). Casing bushing 81 has a tapered bowl and is considered to be a component of rotary table 21. Threads 83 of landing sub 79 are recessed so as to allow a thread protector (not shown) to be placed over them while drill pipe 43 is being run into and out of the well. The thread protector could comprise two semi-circular pieces that are simply placed over threads 83, each semi-circular half having an upper flange to support it on landing sub upper end 79.

Figure 8:
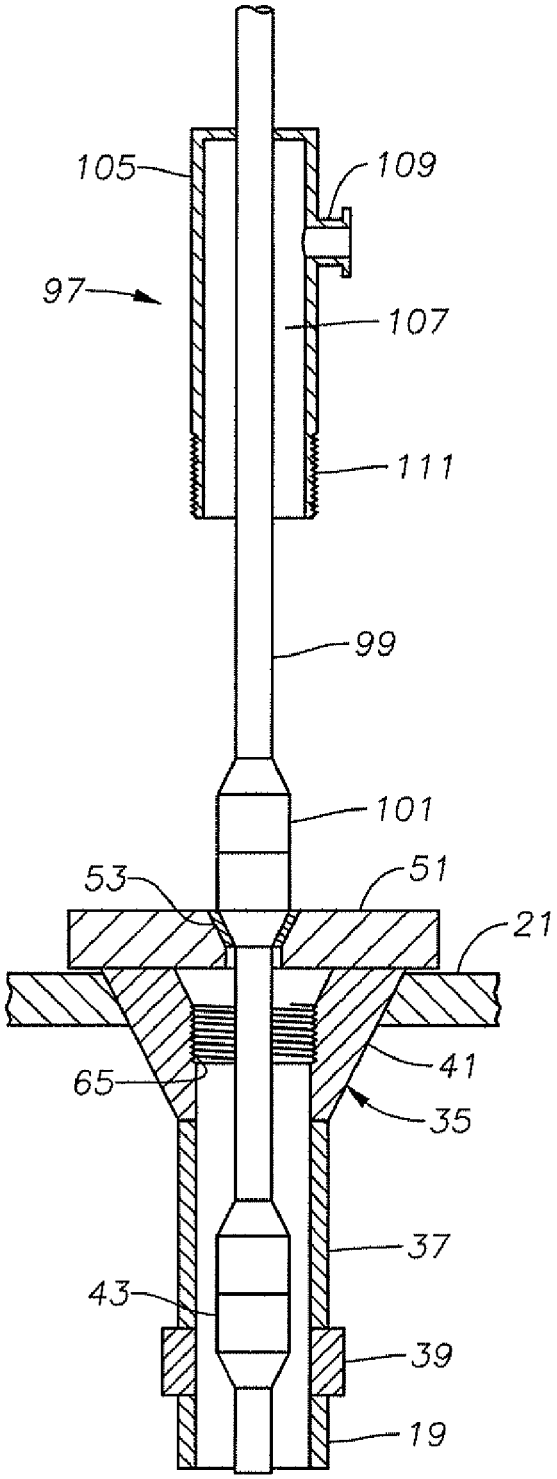
FIG. 8 is a schematic sectional view of an alternate embodiment of a circulation tool shown connected to a landing sub and to drill pipe and supported on a spider resting on the rotary table.
Figure 9:
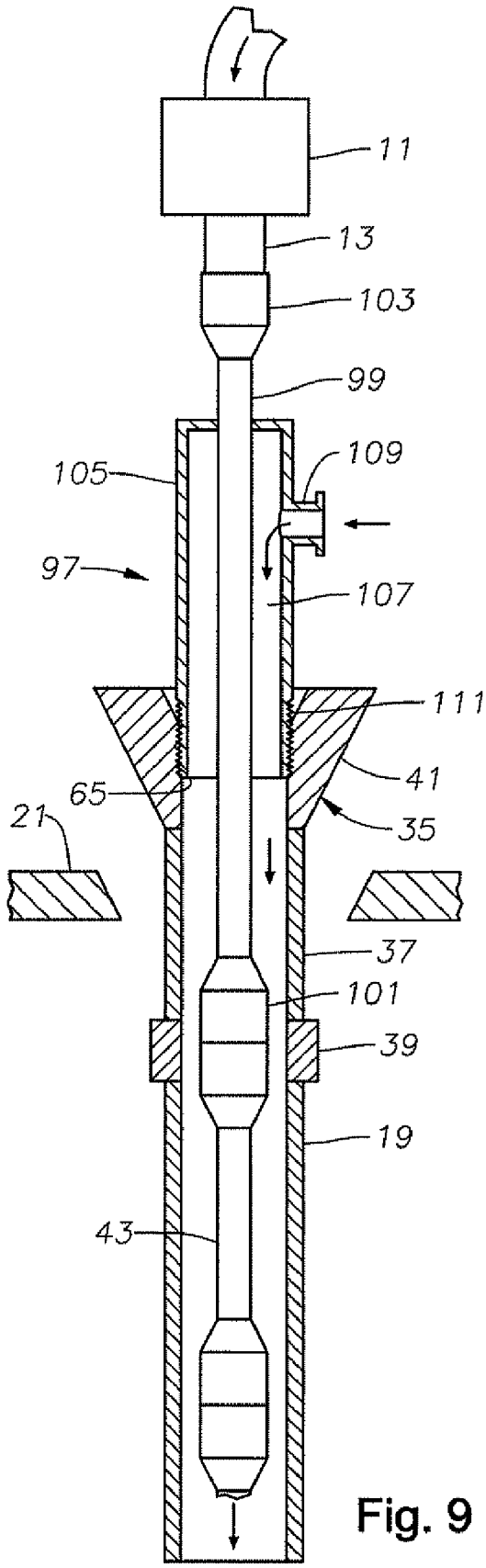
FIG. 9 is view of the circulation tool of FIG. 8, showing the top drive lifting the casing and the drill pipe.

FIGS. 8 and 9 illustrate another embodiment of a circulation tool. Circulation tool 97 has an inner pipe 99 that has a lower threaded end 101 that secures to drill pipe 43. Inner pipe 99 has an upper end 103 (FIG. 9) that connects to top drive quill 13. A housing 105 is secured to inner pipe 99. The upper end of inner pipe 99 is connected to inner pipe 99, as by welding, creating a closed upper end for housing 105. Housing 105 is larger in diameter than inner pipe 99, defining an annular chamber 107 between them. A side inlet 109 connects annular chamber 107 to an external source of fluid, such as drilling fluid. Housing 105 has external threads 111 on its lower end that engage landing sub threads 65, as shown in FIG. 9.

Circulation tool 97 is connected to drill pipe 43, as shown in FIG. 8, when it is desired to circulate and reciprocate. After connecting to drill pipe 43, the operator removes spider 51 and connects housing threads 111 to landing sub threads 65, as shown in FIG. 9. This allows top drive 11 to pick up the entire assembly of circulation tool 97, landing sub 35, drill pipe 43 and casing 19. The operator connects a source of fluid to side inlet 109 and pumps into annular chamber 107. Annular chamber 107 is open at its lower end, causing the fluid to flow down inner annulus 73 and return back outer annulus 34 (FIG. 1). If desired, the operator at the same time can pump down through top drive 11, inner pipe 99 and drill pipe 43.

The circulating systems of both embodiments allow an operator to readily circulate and reciprocate the casing while using drill pipe as a retrieving string to retrieve a bottom hole assembly from casing. The circulating systems also handle well pressure. The second embodiment allows an independent measurement of the shut-in pressure of the drill pipe and of the pressure within the annulus surrounding the drill pipe to be made.

While the invention has been shown in only a few of its forms, it should be apparent to those skilled in the art that it is not so limited but susceptible to various changes without departing from the scope of the invention.

The invention claimed is:

1. A method of retrieving a downhole tool releasably connected to a lower end of a string of casing during a casing-while-drilling operation, comprising:

(a) suspending the casing in the well from a drilling rig floor opening;

(b) running a string of conduit into the casing while it is suspended and engaging and retrieving the downhole tool;

(c) when circulation is desired while the conduit is located within the casing, securing a circulation tool to an upper end of the conduit, lowering the conduit and the circulation tool, and with the circulation tool, closing off an upper end of an inner annulus between the conduit and the casing; and (d) circulating fluid down through the circulation tool and the conduit and back up an outer annulus surrounding the casing.

2. The method according to claim 1, wherein step (a) comprises:

securing a landing sub to an upper end of the casing, then seating the landing sub within a rotary table of the drilling rig.

3. The method according to claim 1, wherein step (c) comprises:

providing the circulation tool with a fastener member that is rotatable relative to a body of the circulation tool, lowering the conduit and the circulation tool until the fastener member is in cooperative engagement with the casing, then rotating the fastener member relative to the body of the circulation tool, the conduit and the casing to cooperatively connect the circulation tool to the casing.

4. The method according to claim 1, wherein step (c) comprises mounting an annular seal around the circulation tool, and sealing the inner annulus with the seal.

5. The method according to claim 1, wherein:

step (c) comprises providing the circulation tool with an axial passage and a port extending from the axial passage to an exterior of the circulation tool; and step (d) comprises pumping the fluid down the axial passage into the conduit and diverting at least some of the fluid through the port and down the inner annulus.

6. The method according to claim 5, further comprising:

selectively closing the port and pumping all of the fluid down the axial passage into the conduit.

7. The method according to claim 1, wherein step (c) comprises:

providing the circulation tool with an inner pipe and an outer housing, defining an annular chamber between the inner pipe and the outer housing;

connecting the conduit to the inner pipe and the inner housing to the landing sub such that the annular chamber is in sealed fluid communication with the inner annulus; and step (d) comprises pumping the fluid into the annular chamber and down through the inner annulus.

8. The method according to claim 1, wherein:

step (c) comprises cooperatively connecting the circulation tool to the casing; and lifting and lowering the circulation tool, which causes the conduit and the casing to move upward and downward in unison.

9. A method of retrieving a downhole tool releasably connected to a lower end of a string of casing during a casing-while-drilling operation, comprising:

(a) providing a tubular landing sub having a threaded lower end and an enlarged upper end, screwing the landing sub to a threaded upper end of the casing, and seating the landing sub within a drilling rig floor opening to suspend the casing in the well;

(b) running a string of drill pipe into the casing while the casing is suspended, defining an inner annulus between the drill pipe and the casing;

(c) when circulation is desired, securing a circulation tool to an upper end of the drill pipe, lowering the drill pipe until at least a portion of the circulation tool is inserted into the landing sub, securing the circulation tool to the landing sub, and closing off an upper end of the inner annulus between the conduit and the casing;

(d) circulating fluid down through the circulation tool and the drill pipe and back up an outer annulus surrounding the casing;

(e) when reciprocation of the casing is desired, raising and lowering the circulation tool while the circulation tool is connected to the landing sub and to the drill pipe; and (f) securing the drill pipe to the downhole tool and retrieving the drill pipe along with the downhole tool.

10. The method according to claim 9, wherein step (f) occurs while the circulation tool is disengaged from the drill pipe and the landing sub.

11. The method according to claim 9, wherein closing off an upper end of the inner annulus in step (c) comprises mounting an annular seal around the circulation tool, and sealing the inner annulus with the seal.

12. The method according to claim 9, wherein:

step (c) comprises providing the circulation tool with an axial passage and a port extending from the axial passage to an exterior of the circulation tool below the seal; and step (d) comprises pumping the fluid down the axial passage into the drill pipe and diverting at least some of the fluid through the port and down the inner annulus.

13. The method according to claim 12, further comprising:

selectively closing the port and pumping all of the fluid down the axial passage into the drill pipe.

14. The method according to claim 9, wherein step (c) comprises:

providing the circulation tool with an inner pipe and an outer housing, defining an annular chamber between the inner pipe and the outer housing;

connecting the conduit to the inner pipe and the inner housing to the landing sub such that the annular chamber is in sealed fluid communication with the inner annulus; and step (d) comprises pumping the fluid into the annular chamber and down through the inner annulus.

15. The method according to claim 9, wherein step (c) comprises:

providing the circulation tool with an externally fastener member that is rotatable relative to a body of the circulation tool, lowering the fastener member into engagement with internal threads provided in the landing sub, then rotating the fastener member relative to the body of the circulation tool and the landing sub to connect the circulation tool to the landing sub.

16. A circulation apparatus for retrieving while drilling with casing a downhole tool using drill pipe, comprising:

a tubular landing sub having a lower end that secures to an upper end of the casing and an upper end that is adapted to seat at a rig floor opening so as to suspend the casing in the well;

the landing sub having an inner diameter sufficient to enable drill pipe to be lowered through the landing sub into the casing, defining an inner annulus between the drill pipe and the casing;

a circulation tool having a lower end portion that secures to an upper end of the drill pipe when circulation is desired;

cooperative engagement members between an inner diameter portion of the landing sub and an outer diameter portion of the circulation tool that releasably secure them together so that lifting the circulation tool lifts the landing sub, the drill pipe and the casing in unison to allow axial reciprocation of the casing;

a seal device on the circulation tool that closes off the inner annulus when the circulation tool is attached to the landing sub and the landing sub attached to the casing; and a passage within the circulation tool adapted to be connected to a source of circulation fluid for flowing the fluid down the casing.

17. The apparatus according to claim 16, wherein the cooperative engagement members comprise:

a fastener member rotatably mounted to a body of the circulation tool, the fastener member having external threads that mate with internal threads provided in the inner diameter portion of the landing sub, enabling the circulation tool to be connected to the landing sub without rotating the body of the circulation tool.

18. The apparatus according to claim 17, wherein:

the passage extends axially through the circulation tool for fluid communication with the drill pipe; and a port extends from the passage to an exterior portion of the circulation tool below the annular seal for communicating some of the fluid to the inner annulus.

19. The apparatus according to claim 18, further comprising:

a closure member that selectively opens and closes the port.

20. The apparatus according to claim 16, wherein the circulation tool comprises:

an inner pipe and an outer housing, defining an annular chamber between the inner pipe and the outer housing that is adapted to be in fluid communication with the inner annulus when the circulation tool is attached to the landing sub and the landing sub attached to the casing; and the passage leads from the annular chamber to an exterior portion of the outer housing to flow the fluid into the annular chamber.

* * * * *